United States Patent [19]

Morrison

[11] Patent Number: 4,596,729

[45] Date of Patent: Jun. 24, 1986

[54] NON-SLIP FLOOR MAT ASSEMBLY

[76] Inventor: Richard A. Morrison, 3 Morgan Road, Baie-d'Urfe, Quebec, Canada, H9X 3A3

[21] Appl. No.: 735,522

[22] Filed: May 20, 1985

[51] Int. Cl.[4] ..... E04C 1/10; B32B 3/10

[52] U.S. Cl. ..... 428/44; 428/131; 52/180; 404/19; 404/36; 404/42

[58] Field of Search ..... 428/44, 131, 45; 52/180, 177; 404/36, 42, 19, 41

[56] References Cited

U.S. PATENT DOCUMENTS 4,468,910 9/1984 Morrison ..... 404/36

*Primary Examiner*—Alexander S. Thomas

*Attorney, Agent, or Firm*—Russell L. Johnson

[57] ABSTRACT

A non-slip floor mat assembly made from a plurality of rectangular shaped floor mat panels which are coupled together provide a mat with a number of improved safety features including non-slip, not dangerous to high heels and good drainage. Each of the floor mat panels is integrally molded with a plurality of parallel extending first elongate members on one portion of each of the floor mat panels, and a plurality of parallel extending second elongate members on another portion of each of the floor mat panels. The first elongate members extend in a different direction to the second elongate members and openings are provided between the elongate members. Parallel ridges with breaks between are provided extending in line along the elongate members to provide a tread surface, and cross members extend across and support the first and second elongate members positioned below the tread surface.

10 Claims, 8 Drawing Figures

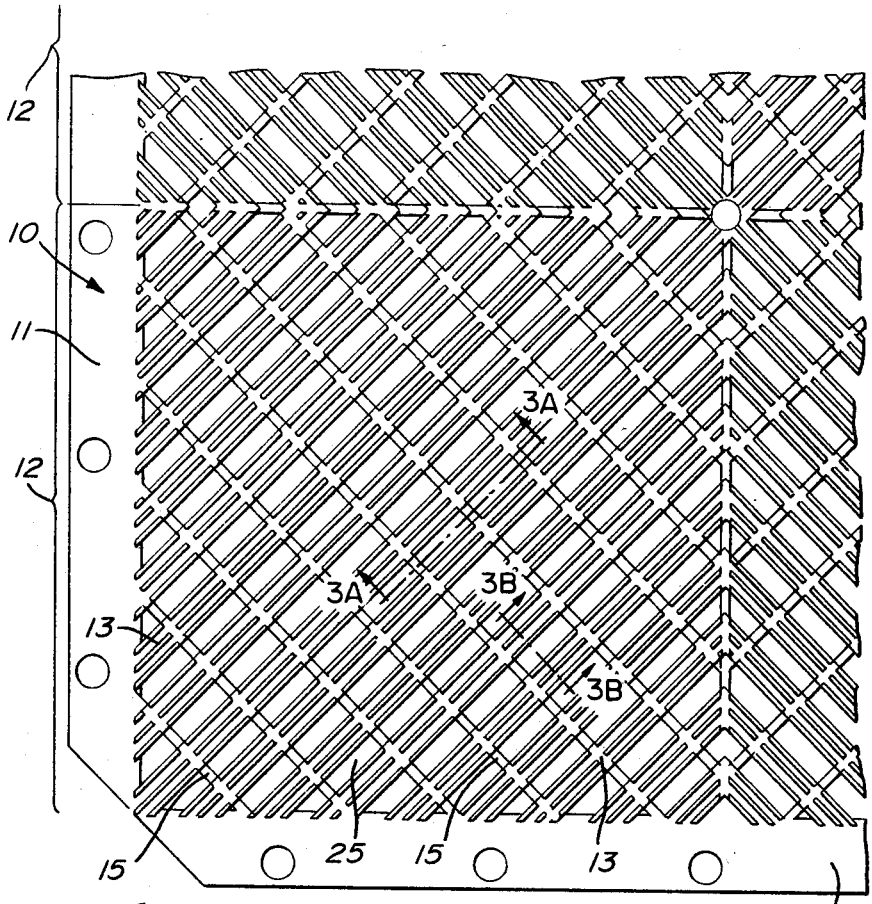
Fig. 1
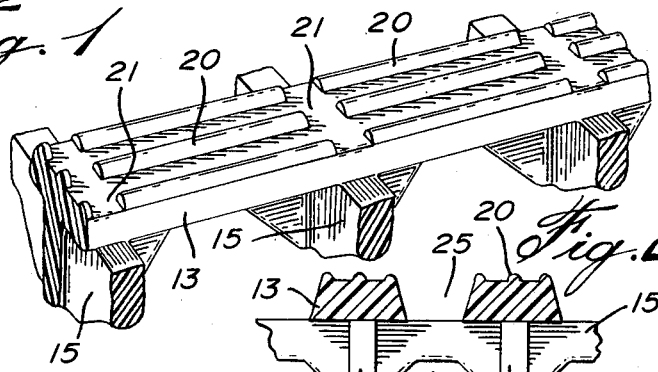
Fig. 2
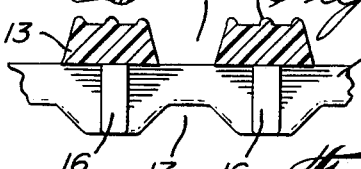
Fig. 3A
Fig. 3B
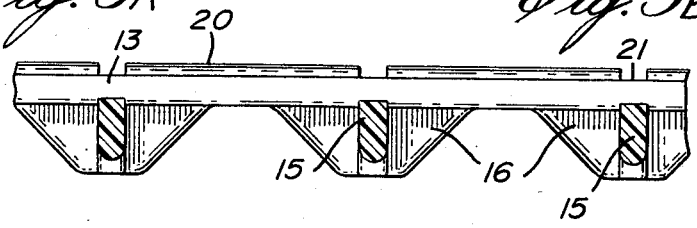

NON-SLIP FLOOR MAT ASSEMBLY

The present invention relates to a floor mat assembly comprising a plurality of rectangular shaped floor mat panels which may be coupled together to provide a non-slip surface.

Anti-skid floor mats are used in many locations. Many of these designs include different panels or modules which clip together and have ramp strips at edges of the floor mat assemblies to permit trolleys and carts to be wheeled onto a floor mat and prevent people tripping on the edges of floor mats. One example of such a floor mat assembly is shown in my U.S. Pat. No. 4,468,910, the disclosure of which is hereby incorporated by reference.

Many different types of floor mats are available today for industrial purposes on factory floors, warehouses ectetera. Most of these floor mats are not really suitable for domestic use on shower floors, boat decks and the like, where bare feet are used on a mat. It is found that most industrial mats are uncomfortable for bare feet and furthermore, if the industrial mat is wet, then bare feet can slip. Furthermore, many industrial mats do not provide satisfactory drainage, and another problem that occurs with some floor mats, particularly those that have cross members linked together, is due to the openings in the mats which are large enough for a heel of a high heel shoe to slip through and get caught in the mat resulting in either loss of a shoe or a fall when walking over such a mat.

Lynn in Canadian Pat. No. 774,797 shows a floor mat made from a series of rubber strips locked together. The assembly is not integrally molded and also shows surface buldges where the strips cross one another and have grooves all aligned in one direction. Such an assembly tends to promote skids in that direction, and may present a safety hazard. Furthermore, the spacing between the strips is large enough for the heel of a high heel shoe to catch therein, and there is little or no provision for liquids to drain away under the mat. Both of these problems can present safety hazards in certain conditions.

It is one object of the present invention to provide a floor mat assembly comprising a plurality of individual rectangular floor mat panels which have an improved safety feature in that a person's feet can not easily slip on the mat regardless of whether the mat is dry or wet. Furthermore, the mat is comfortable to walk on with bare feet. Another object of the invention is to provide a floor mat assembly which does not have openings in the mat large enough for the heel of a high heel shoe to slip through. A still further object is to provide a floor mat that does not clog when waste and other material fall through holes in the mat, and have sufficient space below the surface of the mat for drainage to occur in all directions. All of these improvements provide safety features and overcome hazards that occur in many existing types of floor mats.

The present invention provides in a floor mat assembly comprising a plurality of individual rectangular floor mat panels coupled together, the improvement comprising; each of the floor mat panels being integrally molded with a plurality of parallel extending first elongate members on one portion of each of the floor mat panels and a plurality of parallel extending second elongate members on another portion of each of the floor mat panels, the first and second elongate members having openings therebetween, the first elongate members extending in different directions to the second elongate members, the first and second elongate members having a plurality of parallel ridges extending in line with the elongate members to provide a tread surface and having breaks in the ridges spaced along the elongate members for drainage, and cross members extending across and supporting the first and second elongate members positioned below the tread surface.

In another embodiment, drain spaces are included beneath the elongate members to provide a drainage area at least as large as area of the openings between the elongate members, preferably the openings between the elongate members are less than a high heel width of a standard high heel shoe. Each of the portions in each of the floor mat panels is preferably smaller than an area of a human foot, and the elongate members are supported only at the cross members and flex between the cross members when stepped on to give a cushioned effect. Each of the floor mat panels is substantially square, and in one embodiment, is divided into four equal substantially square portions, wherein the ridges in two diagonal portions are perpendicular to the ridges in the other two diagonal portions.

In yet a further embodiment, braces are provided between elongate members forming the cross members. The ridges of each of the floor mat panels are in one embodiment at forty five degrees to the sides of each of the panels and in another embodiment are parallel to two sides of each of the panels, and perpendicular to the other two sides of each of the panels. The breaks in the ridges preferably occur at locations where the cross members support the elongate members.

Referring now to the drawings,

FIG. 1 is a plan view of a detail showing a portion of a floor mat panel according to one embodiment of the invention, FIG. 2 is an isometric view of a detail showing an arrangement of an elongate member with ridges thereon and cross members underneath, FIGS. 3A and 3B are cross sectional views taken at line 3A—3A and 3B—3B of FIG. 1.

Figure 4:
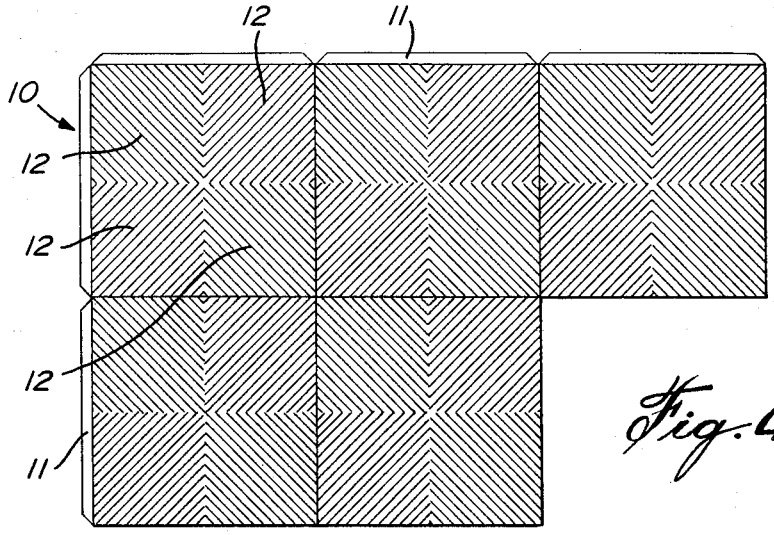
FIG. 4 is a plan view showing a number of floor mat panels coupled together.

Referring now to the drawings, a square floor mat panel 10 is shown with edges 11 arranged to couple with edges 11 of adjacent floor mat panels in a manner similar to that disclosed in my U.S. Pat. No. 4,468,910. The panel 10 has four different tread portions 12 each having elongate members 13 having a tread surface thereon. The elongate members 13 extend at forty five degrees to the edges 11 of the panel 10, and two diagonally opposite tread portions 12 have the elongate members 13 extending parallel and in line. The other two diagonally opposite tread portions 12 have their elongate members 13 at right angles to the elongate members 13 in the first two portions 12.

As can be seen in FIGS. 2, 3A and 3B, each elongate member 13 is supported at spaced apart intervals by cross members 15. Gussets 16 extend from each of the elongate members 13 to the sides of the cross members 15. The gussets 16 strengthen the elongate members 13, but also allow a certain flexing of the elongate members 13 between each cross member 15 when stepped on by a foot. This flexing effect provides cushioning for bare feet and provides a comfortable soft surface rather than a hard rigid surface. Furthermore, the space between the gussets 16 underneath the elongate members 13 allows for drainage and drain slots 17, as shown in FIG. 3B are provided in each of the cross members 15 to ensure that drainage occurs in any direction under the panel 10. The structure of the mat has openings on the surface which increase in size at the base of the mat. Thus, liquids or particles which pass through the top openings fall freely to the floor under the mat and are free to flow to a drain or collector.

Three parallel ridges 20 are shown on the top of each of the elongate members 13 with breaks 21 in the ridges spaced along the length of the elongate members 13. The breaks 21 are preferably positioned above the cross members 15 and allow water that collects in grooves between the ridges 20 to drain. By positioning the breaks 21 over the cross members 15, the cushioning effect for the floor mat panel 10 is retained. Each of the tread portions 12 is shown as being substantially square, with each side much shorter than the length of a human foot, so a good non-slip surface is obtained for the complete panel 10. With the ridges 20 perpendicular in adjoining tread portions 12, slipping is prevented in any direction.

Referring now to FIG. 1, the width of the openings 25 or gaps between the elongate members 12 is generally not greater than three eights of an inch, and is preferably a quarter inch, thus the high heel of a high heel shoe cannot slip into the openings 25 between elongate members 12 and become stuck. The width of the openings 25 between the elongate members 12 can be made larger or smaller depending upon the mat requirements, a floor mat for instance, in a shower can have opening widths greater than three eights of an inch. The floor mat panels are preferably formed integrally out of molded plastic having sufficient resilience to be comfortable and not hard to a bare foot. It is found that parallel ridges are more comfortable for a bare foot than round protrusions or other non-slip treads.

FIG. 4 illustrates five floor mat panels 10 assembled together at the edges 11. The tread portions 12 are arranged so that the ridges 20 on top of the elongate members 13 do not extend linearly for any more than one portion 12, and each portion 12 does not have a side longer than a human foot.

Figure 5:
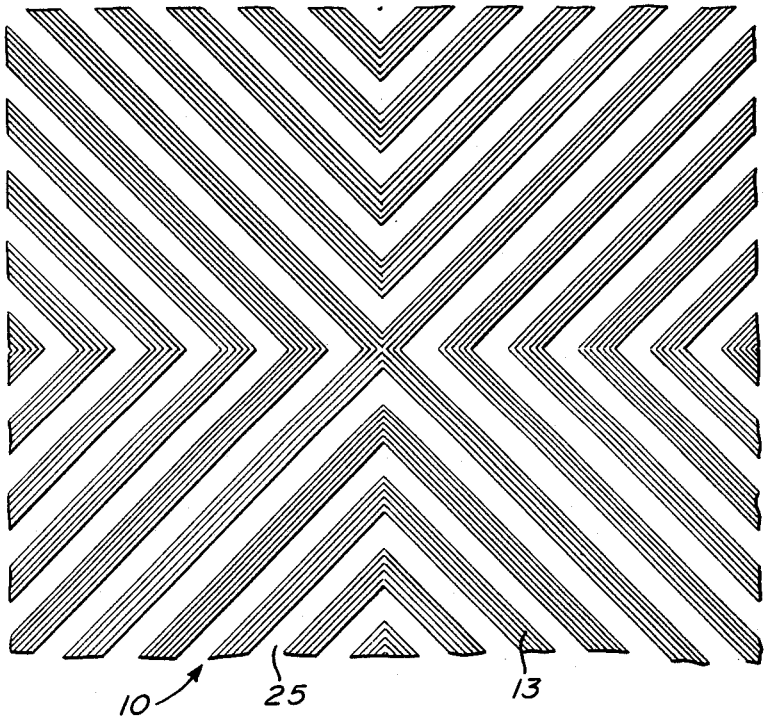
FIGS. 5, 6 and 7 are plan views showing different patterns of tread for a floor mat panel.
Figure 6:
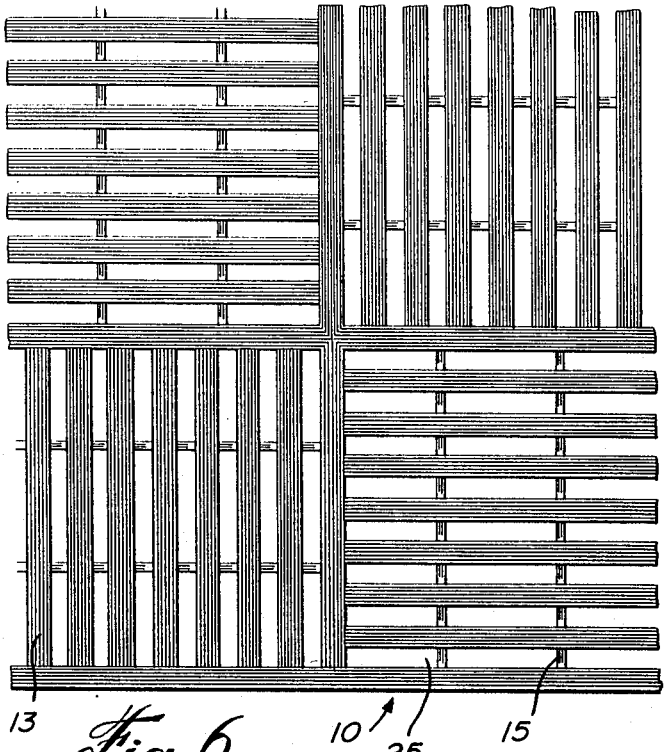
Figure 7:
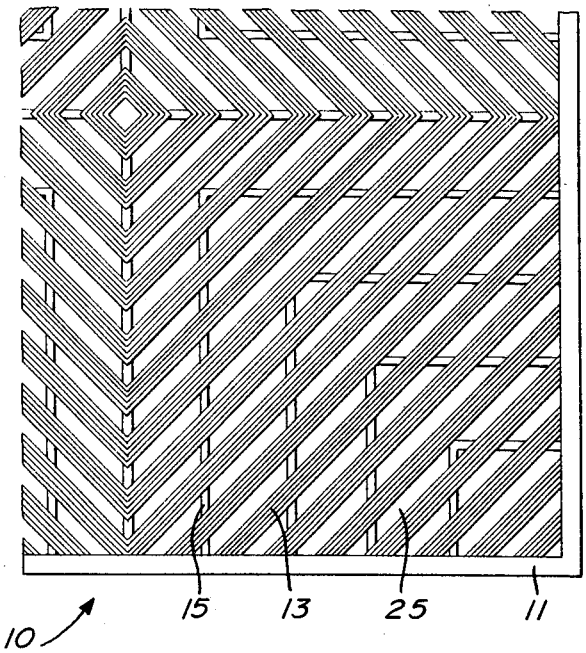

FIGS. 5, 6 and 7 illustrate different patterns suitable for the rectangular floor mat panels. FIG. 5 illustrates the pattern which is shown in FIGS. 1 and 4. FIG. 6 illustrates a pattern for a substantially square panel which has tread portions 12 with elongate members 13 extending at right angles to the sides of the panel 10. The elongate members 13 in one tread portion 12 extend at right angles to the elongate members 13 in an adjacent tread portion 12. FIG. 7 illustrates another embodiment of a design wherein each tread portion 12 has elongate members 13 at forty five degrees to the edge of the panel 10, however, the pattern is arranged differently to that shown in FIG. 5 with the elongate members 13 in one tread portion 12 joining the elongate members 13 in adjoining tread portions 12 to provide a substantially diamond pattern. The pattern comprises a small diamond in the center and increases to a larger diamond at the periphery.

Whereas three different designs are illustrated herein, it will be apparent to those skilled in the art that different designs could also be incorporated providing the same function namely that one tread portion 12 has elongate members 13. The elongate members 13 need not necessarily be straight but could be curved provided they are not in the same direction as the elongate members in an adjacent tread portion. In this way, a bare foot cannot slip from one tread portion to another because the ridges of the tread surface are at a different angle and thus prevent slipping. Various changes may be made to the embodiments shown herein without departing from the scope of the present invention which is limited only by the following claims.

The embodiments of the invention in which an exclusive property or privilege is claimed are defined as follows:

1. In a floor mat assembly comprising a plurality of individual rectangular floor mat panels coupled together, the improvement comprising:

each of the floor mat panels being integrally molded with a plurality of parallel extending first elongate members on one portion of each of the floor mat panels, and a plurality of parallel extending second elongate members on another portion of each of the floor mat panels, the first and second elongate members having openings therebetween, the first elongate members extending in different directions to the second elongate members, the first and second elongate members having a plurality of parallel ridges extending in line with the elongate members to provide a tread surface and having breaks in the ridges spaced along the elongate members for drainage, and cross members extending across and supporting the first and second elongate members positioned below the tread surface.

2. The floor mat assembly according to claim 1 including drain spaces beneath the elongate members to provide a drainage area at least as large as area of the openings between the elongate members.

3. The floor mat assembly according to claim 1 wherein the openings between the elongate members are less than a high heel width of a standard high heel shoe.

4. The floor mat assembly according to claim 1 wherein each of the portions in each of the floor mat panels is smaller than an area of a human foot.

5. The floor mat assembly according to claim 1 wherein the elongate members are supported only at the cross members and the elongate members flex between the cross members when stepped on to give a cushioned effect.

6. The floor mat assembly according to claim 1 wherein each of the floor mat panels is substantially square and is divided into four equal substantially square portions, wherein the ridges in two diagonal portions are perpendicular to the ridges in the other two diagonal portions.

7. The floor mat assembly according to claim 6 wherein the ridges are at forty five degrees to the sides of each of the panels.

8. The floor mat assembly according to claim 6 wherein the ridges are parallel to two sides of each of the panels, and perpendicular to the other two sides of each of the panels.

9. The floor mat assembly according to claim 1 wherein the cross members are braces between elongate members.

10. The floor mat assembly according to claim 1 wherein the breaks in the ridges occur at locations where the cross members support the elongate members.

* * * * *